US006672219B2

(12) United States Patent
Mackerell et al.

(10) Patent No.: US 6,672,219 B2
(45) Date of Patent: Jan. 6, 2004

(54) LOW OBSERVABLE AMMUNITION CASING

(75) Inventors: Brad Mackerell, Draper, UT (US); Ryan Payne, Pleasant Grove, UT (US); Rodger L. Felix, Pleasant Grove, UT (US); Gary M. Renlund, Salt Lake City, UT (US)

(73) Assignee: TTI Armory, L.L.C., Murray, UT (US)

( * ) Notice: Subject to any disclaimer, the term of this patent is extended or adjusted under 35 U.S.C. 154(b) by 0 days.

(21) Appl. No.: 10/336,892

(22) Filed: Jan. 6, 2003

(65) Prior Publication Data

US 2003/0127011 A1 Jul. 10, 2003

Related U.S. Application Data

(60) Provisional application No. 60/345,701, filed on Jan. 4, 2002.

(51) Int. Cl.[7] ..... F42B 3/00; F42B 10/00; F42B 12/00; F42B 30/00; F42B 5/02; F42B 7/02; F42B 5/26; F42B 5/28; F42B 5/30

(52) U.S. Cl. ..... 102/467; 102/430; 102/464; 102/468

(58) Field of Search ..... 102/430, 464, 102/465, 466, 467, 468

(56) References Cited

U.S. PATENT DOCUMENTS 1,678,162 A * 7/1928 Pedersen ..... 428/467
2,972,947 A * 2/1961 Fitzsimmons et al. ..... 102/465
3,048,105 A * 8/1962 Schlatter ..... 102/464
3,732,826 A 5/1973 Johnson
3,848,350 A * 11/1974 Seminiano ..... 42/1 N
3,987,731 A 10/1976 Brzuskiewicz
4,206,707 A * 6/1980 Shores ..... 102/46
4,323,012 A * 4/1982 Driver, Jr. ..... 102/489
4,833,824 A * 5/1989 Cronenwett et al. ..... 47/57.5
4,899,660 A * 2/1990 Brighton ..... 102/447
6,189,454 B1 * 2/2001 Hunt ..... 102/444

* cited by examiner

*Primary Examiner*—Michael J. Carone
*Assistant Examiner*—H. A. Blackner
(74) *Attorney, Agent, or Firm*—Madson & Metcalf

(57) ABSTRACT

A low observable, brass ammunition cartridge casing with an exterior surface having a colored coating which renders the cartridge casing low observable. The colored coating may be deposited onto the exterior surface by various processes, such as electroplating, chemical deposition, and spray painting. The colored coating may be selected from a variety of different colors such as, black, olive green, silver, brown, tan, gray, and white. The colors are typically obtained using conventional pigments and colorants, such as metal oxides. The brass casing exterior surface may be roughened to reduce the gloss or sheen of the casing on the colored coating. The invention includes ammunition cartridges containing a low observable brass casing described above.

25 Claims, No Drawings

LOW OBSERVABLE AMMUNITION CASING

This application claims the benefit of U.S. provisional application Ser. No. 60/345,701, filed Jan. 4, 2002, and entitled LOW OBSERVABLE AMMUNITION CASING.

BACKGROUND OF THE INVENTION

The invention is directed to brass ammunition casings which are treated and/or colored to render them low observable.

FIELD OF THE INVENTION

Modern firearms use a cartridge which includes a casing that houses a propellant, a primer, and a projectile. The design and configuration of ammunition cartridge casings have changed little over the last 75 years. For rifle and handgun ammunition, casings are typically made of brass. Brass is a preferred ammunition cartridge case material because it is a soft metal that does not unduly wear or harm the firing mechanisms of guns and rifles.

One problem with brass casings is they are shiny. They reflect light, which may be visible from long distance. For example, after firing a weapon, the casing is ejected. This occurs in manual, semi-automatic, and automatic weapons. An ejected brass casing may be observed. For instance, a machine gun ejecting casings can be seen more than a mile away. Likewise, casings lying on the ground can also be seen from long distance. In military or covert operations, there is a real need to conceal the location of machine gun or sniper positions.

Hence, there is a need for low observable brass casings. There is also a need for brass casings that have color coatings for other purposes, such as for quick identification of ammunition type or characteristic.

Thus, it would be a significant advancement in the art to provide brass casing that have been treated and colored to render them low observable. It would be a further advancement in the art to provide colored brass cartridge casings to facilitate quick identification of the ammunition type or other ammunition characteristic.

Such colored brass ammunition casings are disclosed and claimed herein.

SUMMARY OF THE INVENTION

The invention is drawn to a low observable, brass ammunition cartridge casing with an exterior surface having a colored coating which renders the cartridge casing low observable. The colored coating may be deposited onto the exterior surface by various processes, including, but not limited to, electroplating, chemical deposition, and spray painting. The colored coating may be selected from a variety of different colors, including, but not limited to, black, olive green, silver, brown, tan, gray, and white. The colors are typically obtained using conventional pigments and colorants, such as metal oxides.

As used herein, a "low observable" coating on the brass casing includes durable coatings and surface treatments that reduce the reflectivity of the casing, particularly with respect to visible light. Low observable coatings reflect limited visible light and blend into many ambient environments. Such coatings may be selected from dark colors, such as black or olive green. Low observable coatings may include camouflage cartridge casings, low sheen cartridge casings, and colored casings to provide identification of the ammunition and its characteristics.

Roughening the brass casing exterior surface may reduce the gloss or sheen of the casing on the colored coating. This will further reduce the observability and reflectivity of the resulting casing. The brass surface can be roughened by mechanical means, such as abrasives or particle blasting. The brass surface can also be roughened by chemical etching processes.

The invention includes ammunition cartridges containing a low observable brass casing described above. The ammunition cartridges may be prepared using conventional manufacturing equipment and techniques. The low observable ammunition cartridges will typically include a low observable brass casing, a quantity of propellant within the casing, a primer for igniting the propellant, and a projectile. The primer is usually affixed to the casing in a manner to be in communication with the propellant through a flash hole. The primer includes pyrotechnic material such as metallic fulminate or lead styphnate and may be located within the center base of the casing or on a rim.

DETAILED DESCRIPTION OF THE INVENTION

The present invention is drawn to brass ammunition casings of various colors. The present invention also includes ammunition cartridges that include brass casings of various colors. The invention includes low-sheen or low-reflective brass casings. The casing finish and coating color may be selected and designed to not reflect light and to blend into the ambient environment. For instance, in forested areas the casings may have a dark or olive green color. In desert areas, the casings may be tan colored. Black is a particularly preferred color because it absorbs all visible light wavelengths. Other typical colors that may be used include brown, silver, gray or white. Still other desired colors or color combinations may be used.

The brass coating is preferably thin, durable, corrosion and heat resistant so that it can be used with conventional ammunition cartridge casings without damaging the chamber or internal firing mechanisms. Colored coatings may be prepared using known electroplating and alternative plating processes, including electroless deposition, physical vapor deposition, ion plating, or other suitable chemical deposition and coating techniques known in the art including, but not limited to, chemical vapor deposition and sputter processes, and post-deposition thermal treatment processes. The coatings should be sufficiently thin and durable such that the casings may be used in conventional ammunition cartridge loading equipment.

The casing may alternatively be colored with a suitable spray paint. Paint is typically not applied to ammunition casings because it tends to "gum up" the drum, cartridge, and firing mechanisms of the fire arm. However, certain spay paints may be used in the present invention provided they have a sufficiently thin coating, low volatility, and/or heat resistance to be used in a firearm without damaging the internal firing mechanisms.

In some applications, it is desirable to roughen or dull the brass surface before applying a colored coating. Roughening the brass surface will produce a low sheen or low gloss on the final colored coating. This has been found to reduce the observability of the resulting ammunition cartridge. The brass surface may be roughened by mechanical or chemical means. One possible method of roughening the surface is to bead blast the casing surface. Various particulates may be used to roughen the surfaces, such as glass and ceramic beads or particles. Alternatively, the brass surface may be roughened through a chemical etching process. Before applying a colored coating, the casing is preferably cleaned and rinsed.

While the following discussion will focus on electroplating methods for applying a colored coating on the brass casing, it will be appreciated that the present invention is not limited to just electroplating methods. Electroless plating and other coating methods may be used to apply a colored coating on the brass casing within the scope of the present invention.

The casing may be electroplated with zinc, nickel, zinc chromate or other metal chromate, or other electroplating material that may contain one or more pigments, colorants or components to produce the desired surface color. Electroplating techniques and metal pigments and colorants are well known in the art. A variety of metal oxide pigments and known colorants may be used for coloring purposes. $Cr_2O_3$ (chromic oxide) is a known green pigment and is a particularly useful pigment for preparing olive green coatings. Black zinc, black chromate, and other chromate pigments may be used. $TiO_2$ (titanium dioxide) is a typical white pigment. The coated casings may have olive green, black, tan, gray, white, or other desired color. The coating preferably has a non-reflective, low-gloss, or matte surface that can be selected to blend into the ground or surrounding environment.

Several color coating and surface preparation variations may be used, which include, but are not limited to:

Black oxide coating.

Nickel-plated, then oxidized.

Blasted brass, then nickel-plated.

Oxidized by exposure to high temperature.

Zinc plated with olive drab chromate or other desired color.

Blasted brass with black oxide coating.

Blasted brass, then oxidized.

Blasted brass, zinc plated with olive drab chromate or other desired color.

Blasted brass, nickel plated and oxidized.

Nickel-plated with desired color.

Blasted brass only.

Spray painted brass.

The coated brass ammunition casing may be used to prepare loaded ammunition cartridges. Such cartridges may be prepared according to conventional techniques and using conventional equipment. Typical ammunition cartridges include the colored brass casing, a primer, a quantity of propellant, and a projectile or bullet.

Ammunition cartridges containing colored brass casing may provide identification of the ammunition type or other ammunition characteristic. For example, a black cartridge may be used to identify a subsonic cartridge. This information is useful to the user who may then adjust the rifle sights accordingly. Alternatively, the colored cartridge may be used to identify that the cartridge is armor piercing or possesses a specific characteristic.

It will be appreciated that the present invention provides a brass casing is treated and colored to render it low observable. Such coloring is useful in covert or other applications when casing visibility is undesirable. The present invention further provides colored brass cartridge casings to facilitate quick identification of the ammunition type or other ammunition characteristic.

The present invention may be embodied in other specific forms without departing from its essential characteristics. The described embodiments are to be considered in all respects only as illustrative and not restrictive. The scope of the invention is, therefore, indicated by the appended claims rather than by the foregoing description.

What is claimed is:

1. A low observable, brass ammunition cartridge for use as rifle or handgun ammunition comprising:

a brass ammunition casing with an exterior surface having a colored coating which renders the brass ammunition cartridge low observable, wherein the colored coating is sufficiently thin and durable to permit the brass ammunition casing to be used in a rifle or handgun firearm without damaging internal firing mechanisms of the firearm;

a quantity of propellant within the brass ammunition casing;

a primer for igniting the propellant; and a projectile.

2. A low observable, brass ammunition cartridge according to claim 1, wherein the colored coating is deposited onto the exterior surface by electroplating.

3. A low observable, brass ammunition cartridge according to claim 1, wherein the colored coating is deposited onto the exterior surface by chemical deposition.

4. A low observable, brass ammunition cartridge according to claim 1, wherein the colored coating is deposited onto the exterior surface by spray painting.

5. A low observable, brass ammunition cartridge according to claim 1, wherein the colored coating is black.

6. A low observable, brass ammunition cartridge according to claim 1, wherein the colored coating is olive green.

7. A low observable, brass ammunition cartridge according to claim 1, wherein the colored coating is selected from silver, brown, tan, gray, and white.

8. A low observable, brass ammunition cartridge according to claim 1, wherein the brass casing exterior surface is roughened by mechanical means.

9. A low observable, brass ammunition cartridge according to claim 1, wherein the brass casing exterior surface is roughened by chemical means.

10. A low observable, brass ammunition cartridge according to claim 1, wherein the colored coating is deposited onto the exterior surface by electroplating and wherein colored coating is black or olive green.

11. A method for preparing a low observable ammunition cartridge casing suitable for use as rifle or handgun ammunition comprising:

obtaining a brass ammunition casing having an exterior surface that is roughened, wherein the brass ammunition casing is sized and configured for use in rifle and handgun ammunition;

coating the exterior surface with a colored material to render the brass ammunition casing low observable; and filling the brass ammunition casing with a propellant.

12. A method for preparing a low observable ammunition cartridge casing according to claim 11, wherein the exterior surface is roughened by mechanical means.

13. A method for preparing a low observable ammunition cartridge casing according to claim 11, wherein the colored material renders the exterior surface black.

14. A method for preparing a low observable ammunition cartridge casing according to claim 11, wherein the colored material renders the exterior surface olive green.

15. A method for preparing a low observable ammunition cartridge casing according to claim 11, wherein the colored material renders the exterior surface a color selected from silver, brown, tan, gray, and white.

16. A low observable ammunition cartridge for use as rifle or handgun ammunition comprising:

a brass ammunition casing with an exterior surface having a colored coating which renders the brass ammunition casing low observable, wherein the colored coating is deposited onto the exterior surface by a plating process or a chemical deposition process, wherein the colored coating is sufficiently thin and durable to permit the brass ammunition casing to be used in a rifle or handgun firearm without damaging internal firing mechanisms of the firearm;

a quantity of propellant within the brass ammunition casing;

a primer for igniting the propellant; and a projectile.

17. A low observable ammunition cartridge according to claim 16, wherein the colored coating is deposited onto the exterior surface by electroplating.

18. A low observable ammunition cartridge according to claim 16, wherein the colored coating is deposited onto the exterior surface by chemical deposition.

19. A low observable ammunition cartridge according to claim 16, wherein the colored coating is black.

20. A low observable ammunition cartridge according to claim 16, wherein the colored coating is olive green.

21. A low observable ammunition cartridge according to claim 16, wherein the colored coating is selected from silver, brown, tan, gray, and white.

22. A low observable ammunition cartridge according to claim 16, wherein the brass ammunition casing exterior surface is roughened by mechanical means.

23. A low observable ammunition cartridge according to claim 16, wherein the brass ammunition casing exterior surface is roughened by chemical means.

24. A low observable ammunition cartridge according to claim 16, wherein the colored coating is deposited onto the exterior surface by electroplating, wherein the colored coating is olive green, and wherein the brass ammunition casing exterior surface is roughened by mechanical means.

25. A low observable ammunition cartridge according to claim 16, wherein the colored coating is deposited onto the exterior surface by electroplating and wherein the colored coating is black.

* * * * *